United States Patent [19]

Drews et al.

[11] 4,174,682

[45] Nov. 20, 1979

[54] AUXILIARY FUEL INJECTION CONTROL CIRCUIT

[75] Inventors: Ulrich Drews, Vaihingen-Pulverdingen; Erich Singer, Besigheim, both of Fed. Rep. of Germany

[73] Assignee: Robert Bosch GmbH, Stuttgart, Fed. Rep. of Germany

[21] Appl. No.: 842,998

[22] Filed: Oct. 17, 1977

[30] Foreign Application Priority Data

Nov. 9, 1976 [DE] Fed. Rep. of Germany ..... 2651087

[51] Int. Cl.[2] ..... F02D 3/00; F02M 7/00

[52] U.S. Cl. ..... 123/32 EE; 123/32 EL

[58] Field of Search ..... 123/32 G, 32 EA, 32 EE, 123/32 EH, 32 EL; 60/276, 285

[56] References Cited

U.S. PATENT DOCUMENTS

| | | | |
|---|---|---|---|
| 3,742,920 | 7/1973 | Black | 123/32 EL |
| 3,866,584 | 2/1975 | Bigalke et al. | 123/32 EL |
| 3,916,170 | 10/1975 | Norimatsu et al. | 123/32 EE |
| 4,073,269 | 2/1978 | Herth et al. | 123/32 EE |
| 4,089,313 | 5/1978 | Asano et al. | 123/32 EL |

*Primary Examiner*—Gerald Brigance

*Attorney, Agent, or Firm*—Edwin E. Greigg

[57] ABSTRACT

An electronic circuit is described for use with an existing fuel injection system in which fuel control pulses are generated on the basis of air flow rate, engine speed and exhaust gas composition. In particular, the existing fuel injection system is assumed to include an exhaust gas sensor with a signal integrator and a throttle position switch which indicates a closed throttle. It is also assumed that the fuel injection system shuts off fuel control pulses when the throttle is closed and engine speed drops below a predetermined value. The present circuit is intended to recognize this fuel shutoff and to set the integrator at an average value irrespective of the "too lean" signal which it receives from the exhaust gas sensor. In this way, upon termination of fuel shutoff, the engine will receive an average mixture rather than a highly enriched one.

5 Claims, 3 Drawing Figures

AUXILIARY FUEL INJECTION CONTROL CIRCUIT

BACKGROUND OF THE INVENTION

The invention relates to an electronic fuel injection system for providing a combustible mixture to mixture-compressing internal combustion engines. More especially, the invention relates to an electronic fuel injection system which processes information related to the air flow rate of the engine and the prevailing engine speed (rpm) into fuel injection control pulses, the duration of which determines the amount of fuel which is injected, for example by electromagnetic injection valves located in the vicinity of the engine. The basic control pulse is then usually corrected by various correcting circuits which take account of a multitude of prevailing engine conditions and may include a so-called λ-control, which also affects the final, corrected duration of the fuel injection control pulses. A λ-control process usually includes an oxygen or so-called λ-sensor located in the exhaust channel and associated with electronic integrating circuitry. The signal from the λ-sensor permits conclusions to be made regarding the original composition of the fuel-air mixture so that a λ-sensor signal may be used in a closed-loop, feedback, type of control which makes it possible to adapt the amount of fuel fed to the engine precisely to prevailing conditions. Such a sensitive and precise closed-loop control is very desirable because it reduces fuel consumption and reduces the toxicity of the exhaust gas.

It is a feature of known fuel injection systems to shut off the fuel supply to the engine completely under certain conditions of operation, for example during overrunning, i.e. when the engine delivers negative torque, for example in downhill operation. That type of operation is identified by two conditions, namely a closed throttle valve and a relatively high engine speed. The fuel is shut off by completely suppressing the previously mentioned fuel injection control pulses. In this condition, i.e., when all fuel is shut off, the oxygen sensor located in the exhaust system will indicate a lean mixture and will cause the integrating circuit within the λ-control loop to run up against its enriching limit.

When the engine leaves this state, for example by running slower than the limiting rpm or because the throttle valve is reopened to supply power when the downhill operation is complete, the fuel-air mixture being fed to the engine will be substantially too rich for a prolonged period of time because the duration of the control pulses can adapt to prevailing conditions only at the relatively slow response rate of the integrator.

OBJECT AND SUMMARY OF THE INVENTION

It is thus a principal object of the invention to provide a fuel injection system which includes means for adjusting the integrator circuit to have an output potential corresponding to an average injection level, for example one corresponding to the air factor λ being unity (1.0), whenever the engine is being operated in overrunning condition at elevated rpm.

It is a further object of the invention to provide an apparatus in which the output potential from the integrating circuit is preset only in a single state, i.e. when the throttle valve is closed and when the fuel injection control pulses are entirely absent. It is a still further object of the invention that in all other operational states of the engine, the circuit automatically disengages from the integrator and permits the integrator to conduct a normal, closed-loop control based on the oxygen sensor.

The invention will be better understood as well as further objects and advantages thereof become more apparent from the ensuing detailed description of a preferred embodiment of the invention, taken in conjunction with the drawing.

DESCRIPTION OF THE PREFERRED EMBODIMENT

Figure 1:
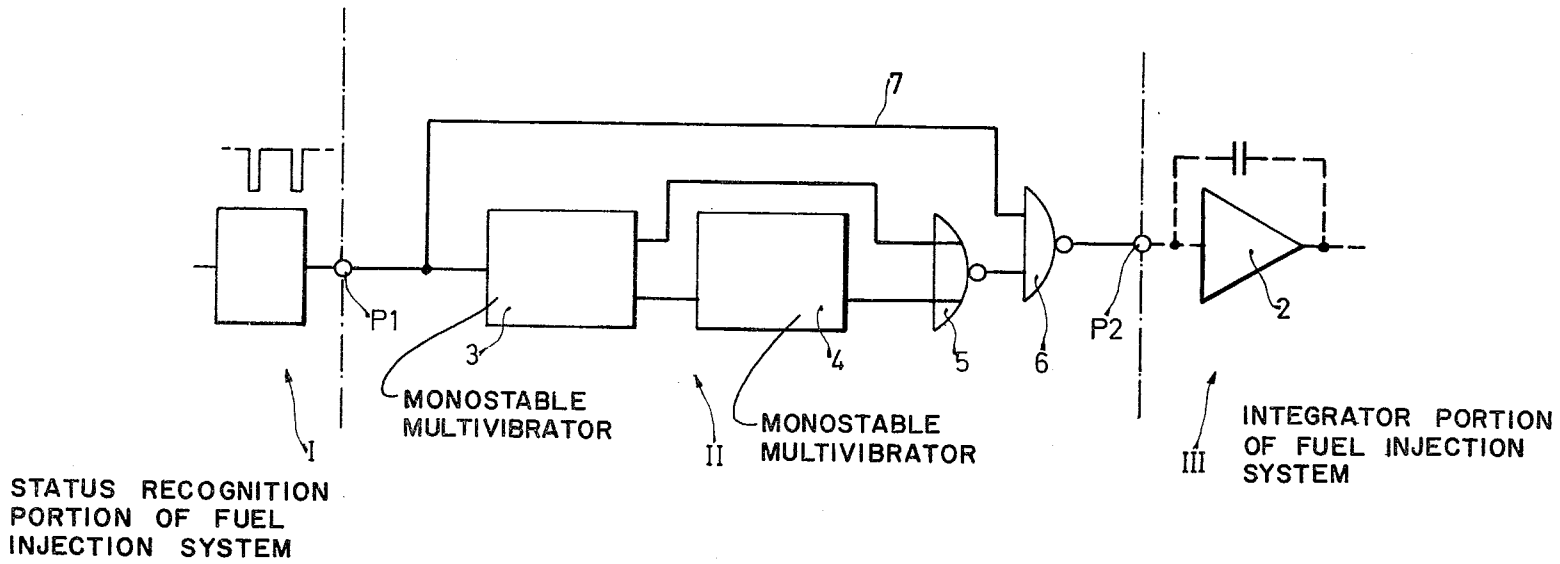
FIG. 1 is a block diagram illustrating the overall fuel injection system including a known injection control circuit followed by the adjustment circuitry according to the present invention which engages further parts of the known fuel injection controller.

Turning now to FIG. 1, there will be seen an exemplary illustration of the circuitry according to the invention used in conjunction with a known fuel injection system. The purpose of the part of the diagram labeled II is to so engage the integrator portion III as to provide an average output signal when the engine is being operated in overrunning condition (negative torque) above a certain speed and in which state the supply of fuel is entirely shut off. Depending on the signal delivered by the λ-sensor after normal operation is resumed, the system may react quickly in the desired location from the average level to which it was held during overrunning.

The circuitry to be further described and constituting the heart of the present invention is designated with "II" and its purpose is to be associated with an electronic fuel injection system which has its terminal portion indicated by "I" and without affecting the latter to any substantial degree.

The points at which the circuit II engages the circuit I are designated P1 and P2. The conditions which may prevail at the circuit junction P1 depend on the state of operation of the engine and may be the following:

1. In normal operation, (i.e., when the throttle valve is opened to varying degrees and fuel injection control pulses are being generated under λ-sensor control) it shall be assumed that the junction P1 will exhibit a voltage equivalent to a logical state 0, i.e. a normally low voltage. Such a low voltage signal will be provided by the collector of a switching transistor which, under normal conditions, conducts and therefore connects the point P1 to ground potential, for example 0 volts.

2. Under overrunning conditions, e.g. in downhill operation, when the engine supplies negative torque, and when fuel control pulses are absent, the junction P1 will exhibit the logical state "1", an elevated voltage, and this voltage is supplied by the collector of the same transistor which is then blocked, thereby forcing the point P1 to substantially the level of the supply voltage.

3. In normal idling, the above-mentioned transistor will also be blocked, i.e. the junction P1 will be at an elevated potential, equivalent to a logical state 1. However, in this case, the junction P1 will receive short triggering pulses which are shown schematically in FIG. 1 and these are due to the fact that the transistor is rendered conducting for short periods of time during the existence of positive fuel control pulses, i.e. during injection.

The circuit according to the invention utilizes the conditions prevailing at the point P1 and it will be explained below in what manner the voltage at the point P1 is actually obtained.

Figure 2:
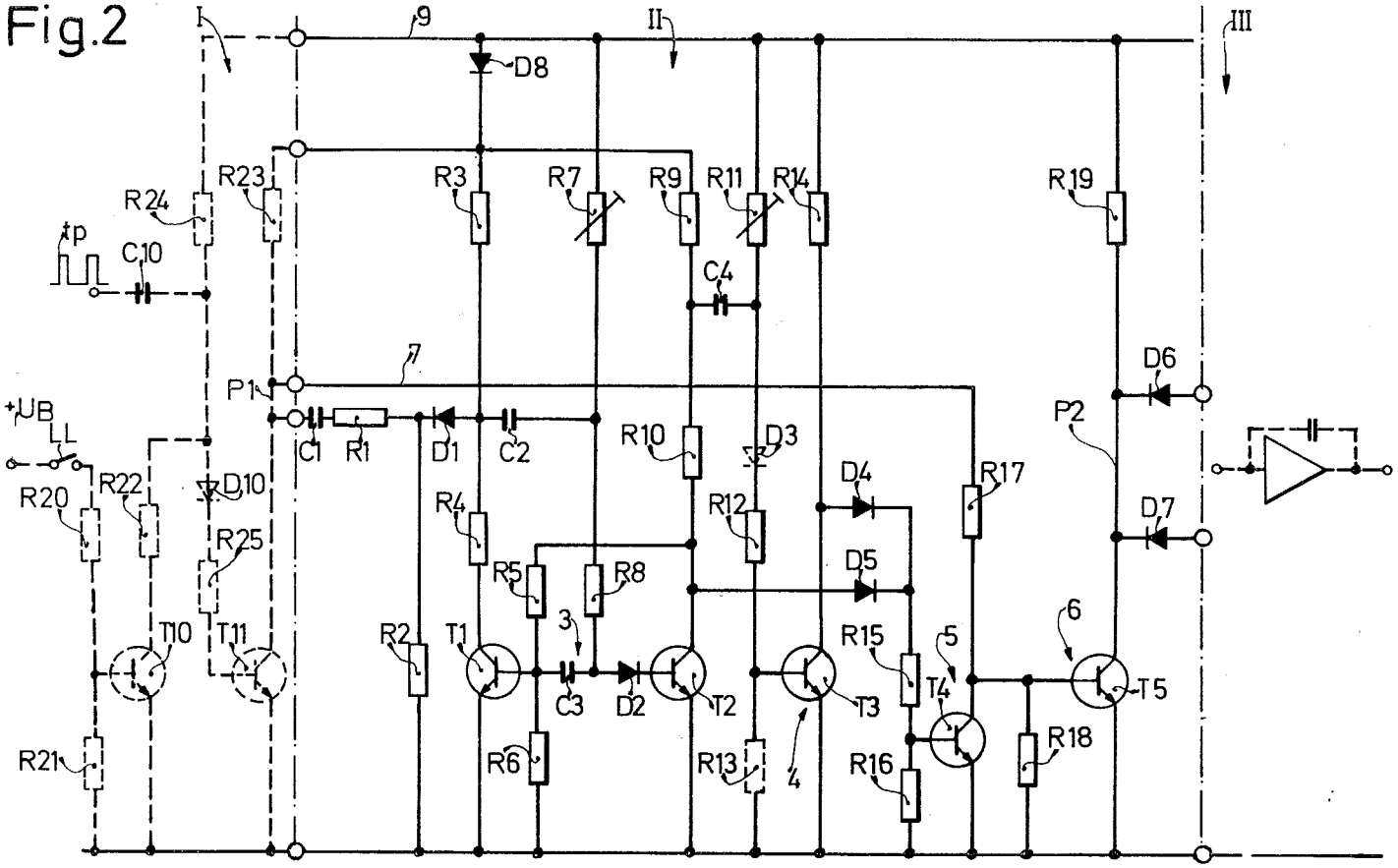
FIG. 2 is a detailed circuit diagram of the adjustment circuit according to the invention.

The point P2 in the circuit illustrated in FIGS. 1 and 2 is the point at which the circuit II according to the present invention engages the subsequent electronic fuel injection system which is of known construction and which is illustrated in FIG. 1 as an exemplary embodiment with an integrating circuit 2 whose output constitutes a portion of the λ-control process and determines the duration of fuel injection control pulses and thus adjusts the fuel-air mixture as a function of the exhaust gas composition. To aid in the understanding of the following description, let it be assumed that the circuit II according to the invention engages the integrator whenever its output signal at the point P2 is a logical 0, i.e. a low relative voltage. Conversely, the circuit II shall be assumed to be without effect when its output signal is a logical 1, i.e. a relatively elevated voltage and, in that case, the integrator 2 of the circuit III which is part of the fuel injection system adjusts its output potential exclusively on the basis of values received via the λ- or oxygen sensor disposed within the exhaust channel.

The supplementary circuit II according to the present invention, which is effectively connected between the two circuit points P1 and P2 of an existing fuel injection system, includes a monostable multivibrator circuit 3, a subsequent second monostable multivibrator 4 and a NOR gate 5 having two inputs each of which receives one of the outputs from the monostable multivibrators 3 and 4. The circuit then further includes a NAND gate 6, one input of which is connected to the output of the previous NOR gate 5 whereas the other input is connected to the circuit point P1. The output of the NAND gate 6 finally constitutes the circuit junction point P2 which is at the same time the input to the integrating circuit III.

The circuit II, as will be explained in detail below, is capable of generating voltage levels at the point P2 in correspondence with various operational states of the engine as already referred to above and on the basis of the voltages which are present at the junction P1. A brief review of the various states of the circuitry indicates the following:

In normal operation, when the circuit point P1 carries a logical 0, one input of the NAND gate 6 receives a logical 0 via a wire 7 while the other input receives a logical 1 from the output of the NOR gate 5. The logical 1 at the output of the NOR gate 5 results from the fact that both flip-flops 3 and 4 are quiescent and do not receive triggering pulses so that both of their outputs have a logical 0. Accordingly, the output of the NAND gate will be a logical 1 which, as previously agreed, is assumed to represent a non-interaction with the normal operation of the integrator 2.

In idling operation, the circuit point P1 carries a logical 1 which is delivered to one of the inputs of the NAND gate 6 but the point P1 also exhibits short term triggering pulses equivalent to the normal fuel injection control pulses at idling and thereby triggers the multivibrator 3 into its metastable state which, after the return of the flip-flop 3, results in the triggering of the subsequent flip-flop 4 into its metastable state. At least one of the inputs of the NOR gate 5 therefore always has the logical state 1 so that the output of the NOR gate will be a logical 0 which, in turn, results in a logical 1 at the output of the NAND gate 6 during idling. Therefore, as in the previous situation, the normal operation of the integrator 2 will not be affected by the switching events in the circuit II. The sum of the unstable time constants of the multivibrators 3 and 4 is chosen to be larger than the time between sequential triggering pulses prevalent at the circuit point P1.

In overrunning operation (negative torque) and when the fuel injection control pulses are entirely suppressed, the junction P1 carries a logical 1 as does one of the inputs of the NAND gate 6. In this situation, the flip-flops 3 and 4 are not triggered at all so that their output voltages are both low (logical 0) resulting in the output of the NOR gate 5 being a logical 1. The circuit point P2 therefore resides at a logical 0 which is understood to imply that the circuit II engages the circuit III in the sense of changing the normal integrating behavior in that circuit by holding the output of the integrator at an average level.

The input portion of the integrating circuit 2 within the circuit III must be so constructed that, when the circuit point P2 is at a low voltage (logical 0), it is possible to transmit a signal into the circuit III whereas, when the point P2 carries a logical 1 no such signal can be propagated and the circuit II is effectively uncoupled from the integrator. The construction of the input portion of the circuit III will suitably include one or several diodes whose cathodes are connected to the point P2 so that when the point P2 is at a logical 0 or ground potential, these diodes conduct, thereby permitting a propagation of signals, possibly through resistors and the like, to the integrator. The detailed construction of an exemplary embodiment for obtaining the function previously discussed with respect to FIG. 1 is illustrated in the circuit diagram of FIG. 2 in which parts of the circuit previously referred to retain the same reference numerals. The circuit diagram of FIG. 2 will be seen to be divided into three parts by two vertical dash-dot lines, i.e. the circuit portions I, II and III. The monostable multivibrator 3 is constructed in substantially customary manner by two transistors T1 and T2 and any triggering pulses present at the point P1 pass through the series connection of a capacitor C1, a resistor R1, a negatively conducting diode D1 and a capacitor C2 into a voltage divider consisting of a variable resistor R7 and a resistor R8 to the base of the transistor T2. The collector of the transistor T2 is connected back to the base of the transistor T1 via a resistor R5 and the base of T1 is grounded via a resistor R6. In the exemplary embodiment shown, the positive voltage supply bus is designated with the numeral 9 while the relatively more negative bus is labeled 8. It will be appreciated by anyone familiar with the art however that these are only convenient designations which could without difficulty be changed in polarity with the use of semiconductor elements of different polarity. The collector of the transistor T1 is connected via series resistors R3 and R4 to a point in the circuit which is also connected to the collector of the transistor T2 via resistors R9 and R10. That point of the circuit may be connected directly to the positive bus 9 or via an intermediate diode D8 with indicated polarity. The diode D8 serves to protect the circuit against sudden surges in the supply voltage. The same protective service is provided by the resistors R8 and R10 as well as by the capacitor C3 which, together with the diode D2 connects the bases of the two transistors T1 and T2. The signal from the transistor T2 is taken to the input of a monostable multivibrator 4, a so-called economy flip-flop, which is constituted by a single transistor T3 whose base is coupled to the collector of T2 via a capacitor C4, one electrode of which is connected to the junction of the previously referred-to collector resistors R9 and R10. The other side of the capacitor C4 goes to the junction of voltage divider resistors R11, R12, R13 and, possibly, a series diode D3 connected as shown. The diode D3 as well as the diode D2 may be omitted and serves only for protecting the base-emitter path of the associated transistor. The output of the second monostable multivibrator 4 is taken from the collector of the transistor T3 which itself is connected to the positive supply bus 9 via a resistor R14.

Following the monostable multivibrators 3 and 4 is the previously referred-to NOR gate 5, which is formed by a transistor T4 whose base is connected to the outputs of the monostable multivibrators 3 and 4 via respective diodes D5 and D4 and a common series resistor R15 which is grounded through a further resistor R16 to provide a divided base voltage for the transistor T4.

Following the transistor T4 is a transistor T5 which constitutes the previously identified NAND gate 6 and the transistor T5 receives its base voltage from the collector of the transistor T4 which lies at the junction of two resistors R17 and R18 which constitute a voltage divider chain between the circuit point P1 and ground.

The circuit as described so far operates in the following manner. During normal engine operation, the series-connected resistors R7 and R8 supply base current to the transistor T2. In the same manner, the base of the transistor T3 receives base current via the resistors R11 and R12. Both of these transistors therefore conduct and cause the outputs of the flip-flop circuits 3 and 4 to carry a low output voltage equivalent to a logical 0.

The portion of the existing control circuit I is illustrated in dashed lines and is intended to represent merely one possible exemplary embodiment but is so constructed as to provide the previously identified voltage at the point P1 when the engine operates in the various identified states. This circuit includes a first transistor T1 whose base is connected to the junction of series resistors R20 and R21 which are supplied with current via an idling switch or a throttle valve position switch LL that indicates when the engine is idling by closing the circuit from a source of positive potential $+U_B$ and supplying the base of the transistor T10 with current, thereby rendering it conducting. The collector of the transistor T10 is connected via a resistor R22 to the base of a subsequent transistor T11 whose collector constitutes the previously identified circuit point P1 and is also connected via a resistor R23 to the source of positive voltage at the cathode of the diode D8. The base of the transistor T11 is connected through a resistor R24, a diode D10 and a resistor R25 with the overall positive supply voltage delivered by the supply bus 9. The junction of the resistor R24 and the diode D10 is connected to the collector of the transistor T10 via the resistor R22. When the engine idles, i.e., when the transistor T10 conducts and the transistor T11 blocks, the collector of the transistor T11 nevertheless should exhibit pulses occurring in synchronism with the fuel injection pulses $t_p$ so that the subsequent monostable multivibrators 3 and 4 may be properly triggered. In order to insure that these pulses are present on the collector of the transistor T11, its base may be connected, for example at the junction of resistors R22 and R24, to the source of the positive fuel injection control pulses $t_p$, preferably via a capacitor C10. In this manner, the transistor T11 will be triggered into conduction for very short periods of time whenever fuel injection pulses $t_p$ are occurring. In the exemplary embodiment shown, the transistor T11 and a further transistor (not shown) together constitute a bistable flip-flop so that, during idling, the transistor T11 is rendered conducting for a time equal to the duration of the fuel injection pulses $t_p$.

When the above-described circuit is considered with respect to its function during the three previously mentioned operational states, i.e. normal operation (1), overrunning operation (2) when fuel control pulses are entirely absent, and idling operation (3), it will be found that in normal operation when the idling switch LL is open, the transistor T10 blocks and the transistor T11 is held in the conducting state via the resistors R24, R25 and the diode D10. The collector of the transistor T11 is thus at near ground potential (zero volts), i.e. it assumes the logical state 0. The same state (logical 0) occurs at the outputs of the multivibrators 3 and 4, actually constituted by the collectors of transistors T2 and T3 respectively, because these transistors are not triggered during the normal engine operation. Thus, the transistor T4 remains blocked and the base of the transistor T5 is at the low potential of the point P1 causing it to block as well. The collector of T5 thus carries approximately positive supply potential $U_B$ which causes the subsequent diodes D6 and D7 to block and result in an effective uncoupling of the circuit II from the subsequent control circuit III containing the integrator 2.

In overrunning operation, i.e. when the throttle valve is closed but the engine is running at relatively elevated speeds, for example during downhill vehicle operation, the transistor T10 conducts. However, the fuel injection system will have suppressed the fuel injection control pulses in a particular rpm domain after which the transistor T11 will be completely blocked. Its collector potential, which constitutes the voltage at the point P1, will thus be high (logical 1), causing the transistor T5 to conduct while the transistor T4 is blocked due to the fact that it receives a logical 0 from the outputs of the multivibrators 3 and 4 which are not being triggered. Thus, during overrunning operation, when the control pulses are absent, the conducting transistor T5 permits an interaction with the subsequent integrator 2 due to the fact that the cathodes of the diodes D6 and D7 at the point T2 are held low. The manner in which the λ-control process is altered when the junction P1 is held at high potential, i.e. when interaction is permitted, it is not a specific subject of the present invention and will not be discussed in detail.

The switching diodes D6, D7 may be connected with a voltage divider which is adjusted to deliver an average input signal to the integrator. This average signal is formed only in case junction P1 is held at high potential and overrides any other input signal to the integrator. Diodes D6, D7 may connect the voltage divider to ground (transistor T5 is conducting).

When the engine idles normally and normal fuel injection control pulses are being delivered, no adjustment is necessary and therefore the circuit II should insure that no interference with the normal control process takes place. The closed-loop λ-control is assumed to be working normally. In the idling state, the transistor T11 will be blocked because its base is held at the ground potential of the collector of T10 which is rendered conducting by the closed switch LL. However, the pulses passing through the capacitor C10 to the base of T11 render the transistor T11 conducting for short periods of time at the occurrence of the fuel control pulses, thereby causing the subsequent circuit elements 3, 4 and 5 to hold the transistor T5 conducting. This occurs because the negative-going edge of the triggering pulse at the collector T11 causes the monostable multivibrator 3 to be triggered, i.e. the transistor T2 blocks and the transistor T1 conducts. The transistor T4 which constitutes the NOR gate now receives base current via the resistors R9, R10, the diode D5 and the resistor R15, thereby pulling the base of the transistor T5 to near ground (logical 0), causing T5 to block. As previously explained, this places a positive potential on the cathodes of the diodes D6 and D7, thereby preventing the aforementioned adjustment of the integrating circuit 2.

Figure 3:
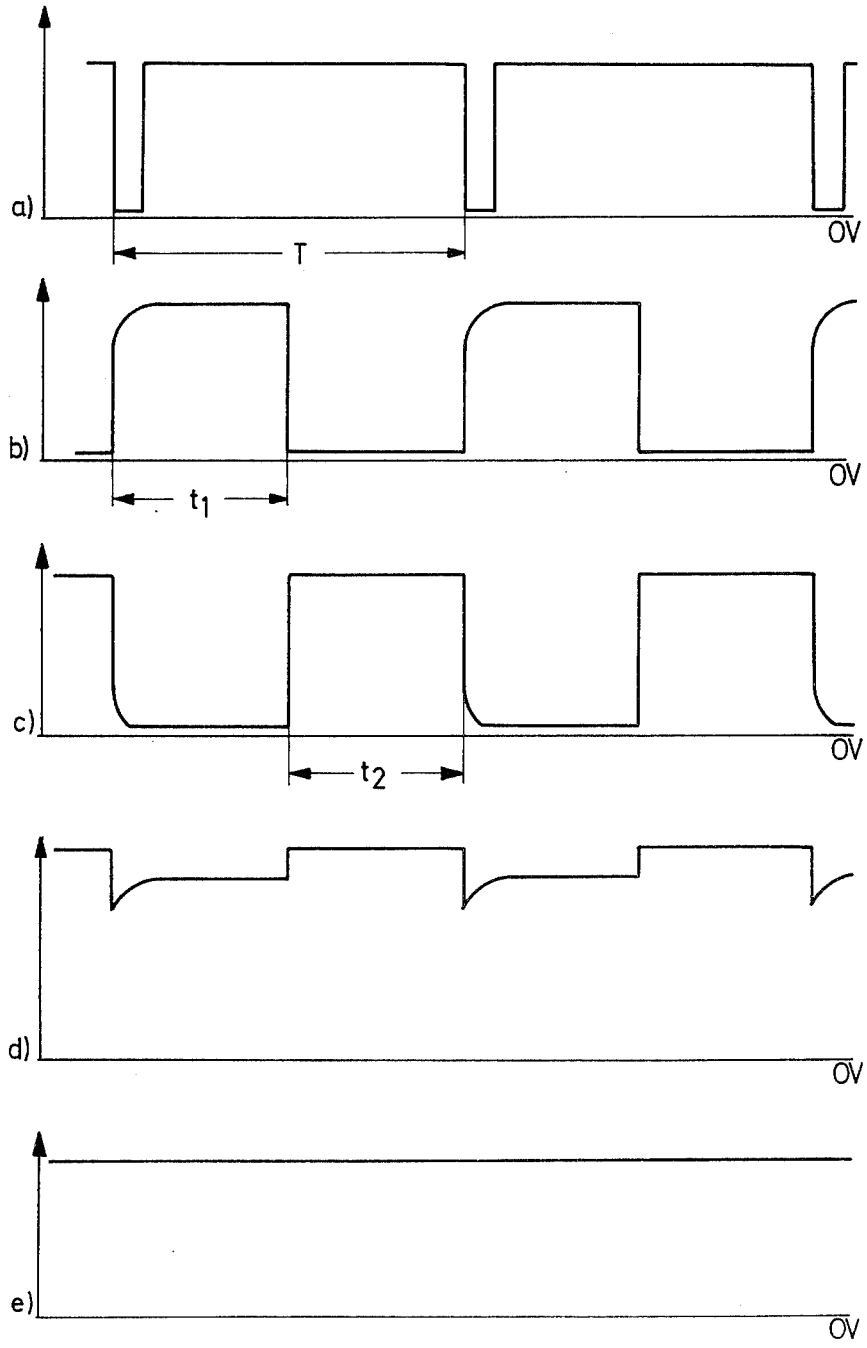
FIG. 3 is a set of diagrams illustrating voltages present at various points of the circuit according to the invention.

FIG. 3 is a set of diagrams illustrating voltages which are present at various points of the circuit. The curve "a" illustrates the voltage at the collector of the transistor T11 and there will be seen the short-term triggering pulses. The lowest idling rpm corresponds to the period T. The curve "b" of FIG. 3 illustrates the voltage at the collector of the transistor T2. After the unstable time constant T1 of the first multivibrator 3 is terminated, the transistor T2 flips back into its stable state and its collector potential returns to near ground. However, the negative-going edge of that pulse causes the second multivibrator 4 to assume its metastable state, thereby blocking the transistor T3 whose collector voltage is shown in the curve "3c". The blocked transistor T3 causes the transistor T4 to remain in the conducting state via resistors R14, the diode D4 and the resistor R15 while the transistor T5 blocks. Suitably, the time constant t1 of the first flip-flop 3 is so chosen that it is equal to approximately half the largest period between pulses, i.e. that occurring at the lowest idling rpm. The time constant t2 of the second monostable multivibrator 4 is then chosen so that when the two time constants are added, their sum is somewhat larger than the maximum period (the time between triggering pulses at the transistor T11) at the smallest idling rpm. If the components are all properly chosen, the trimming resistors R7 and R11 in the base circuits of transistors T2 and T3 may also be replaced by fixed resistors.

As may be seen from the curve "3d", the voltage at the cathodes of the diodes D4 and D5 always remain sufficiently high so that the transistor T4 always conducts so that, as shown in the curve "3e", the collector of the transistor T5 carries a sufficiently high potential during idling operation that permits the diodes D6 and D7 to be blocked and thereby prevent any influence on the integrator 2.

It is a particular advantage in the circuit according to the invention that the time constants of the multivibrators 3 and 4 are not required for the purpose of any reference comparison and any possible drift in their value is not especially serious. Thus, if the RC members for the respective multivibrators, i.e. R7,C2 for the circuit 3 and R11, C4 for the circuit 4, are suitably chosen, then the resistors may, from the start, be fixed resistors. Care must be taken, however, that the sum of the time constants of the monostable multivibrators is always somewhat greater than the maximum period T which occurs at minimum engine speed. It should also be noted that the positive-going edge which occurs at the collector of the transistor T2 resets the monostable multivibrator 3 because the speed will then be above the smallest idling rpm but below the engine speed at which fuel injection pulses are cut off completely by the controller.

The foregoing relates to a preferred exemplary embodiment of the invention, it being understood that other embodiments and variants thereof as well as equivalent components are possible within the spirit and scope of the invention.

What is Claimed and Desired to be secured by Letters Patent of the United States is:

1. An electronic circuit for use with an electronic fuel injection system for an internal combustion engine, said engine having an air intake duct and fuel injection valves and said fuel injection system including means for making measurements of the air flow rate through said air intake duct; means for making measurements of the speed (rpm) of said engine; means for making measurements of the exhaust gas composition and for generating an exhaust gas datum; electronic fuel control means for processing said measurements and generating fuel control pulses for controlling the duration of opening of said fuel injection valves; a throttle valve transducer for generating a first signal when said throttle is closed; and means for suppressing said fuel control pulses when said throttle is closed and the engine runs at higher than idling speed; and wherein said electronic circuit comprises:

a signal-delaying subcircuit, for receiving said first signal and said fuel control pulses;

a logical gating subcircuit for receiving said delayed fuel control pulses and said first signal; and an output circuit controlled by said logical gating subcircuit, for engaging said electronic fuel control means to supply an average (fixed) value of said exhaust gas datum; whereby the width of said fuel control pulses is set to an average value.

2. An electronic circuit as defined by claim 1, wherein said signal-delaying subcircuit includes first and second monostable multivibrators connected in series, said first monostable multivibrator being triggered by pulses derived from said fuel control pulses and the output of said first multivibrator being used to trigger said second multivibrator and wherein said logical gating subcircuit includes a NOR gate for receiving the outputs from said first and second multivibrators, and a NAND gate one of whose input receives the output from said NOR gate while another input of said NAND gate also receives said pulses related to said fuel control pulses which are used to trigger said first multivibrator.

3. An electronic circuit as defined by claim 1, wherein said fuel injection control means includes an integrating circuit for processing said exhaust gas datum, and diodes connected between said integrator and said NAND gate in said electronic circuit and wherein the output voltage of said NAND gate in said electronic circuit is so chosen that said integrator is engaged by said electronic circuit only when said throttle is closed and when said fuel injection pulses are suppressed by said electronic fuel control means.

4. An electronic circuit as defined by claim 2, wherein said throttle valve transducer includes a throttle position switch which controls a first transistor which in turn controls a normally conducting second transistor whereby when said throttle switch is closed, said second transistor generates an elevated voltage (logical 1) which is fed to said NAND gate in said electronic circuit and serves to thereby enable engagement of said integrator in said electronic control means except when said engine runs at idling speed and triggering pulses derived from said fuel control pulses are transmitted by said first and second monostable multivibrators through said NOR gate to a transistor in said NAND gate which blocks.

5. An electronic circuit as defined by claim 4, wherein said second monostable multivibrator is formed with only one transistor and wherein the collectors of the output transistor from said first monostable multivibrator and the single collector of said second monostable multivibrator are both connected through diodes to a further transistor (T4) which constitutes said NOR gate in said electronic circuit and wherein said electronic circuit further includes an output transistor (T5), the collector-emitter path of said transistor (T4) being connected in parallel with the base-emitter path of said transistor (T5) and said transistor (T5) receiving control pulses from said fuel control means and being placed in conduction only when said transistor (T4) is blocked.

* * * * *